US006474943B2

(12) United States Patent
Kataoka et al.

(10) Patent No.: US 6,474,943 B2
(45) Date of Patent: Nov. 5, 2002

(54) FAN SHROUD FOR VEHICLE MOUNTED HEAT CONVERTER

(75) Inventors: Takayoshi Kataoka, Tokyo (JP); Shunichi Nakao, Sagamihara (JP)

(73) Assignee: Nissan Motor Co., Ltd., Kanagawa (JP)

( * ) Notice: Subject to any disclaimer, the term of this patent is extended or adjusted under 35 U.S.C. 154(b) by 0 days.

(21) Appl. No.: 09/885,019

(22) Filed: Jun. 21, 2001

(65) Prior Publication Data

US 2002/0009365 A1 Jan. 24, 2002

(30) Foreign Application Priority Data

Jul. 24, 2000 (JP) ..... 2000-222626

(51) Int. Cl.[7] ..... F04D 29/54

(52) U.S. Cl. ..... 415/173.1; 415/211.1; 416/189

(58) Field of Search ..... 416/169 A, 179, 416/189, 191; 415/173.1, 208.1, 211.1; 123/41.49

(56) References Cited

U.S. PATENT DOCUMENTS 4,189,281 A * 2/1980 Katagiri et al. ..... 415/211.1 X
4,194,556 A * 3/1980 Watanabe et al. ..... 415/211.1 X
4,969,421 A * 11/1990 Haner et al. ..... 415/208.1 X
6,024,536 A * 2/2000 Tsubakida et al. ... 416/169 A X
6,070,560 A * 6/2000 Johnston et al. ..... 123/41.49 X

* cited by examiner

*Primary Examiner*—Edward K. Look
*Assistant Examiner*—Richard A. Edgar
(74) *Attorney, Agent, or Firm*—Shinjyu Global IP Counselors, LLP

(57) ABSTRACT

A fan shroud is provided for a cooling fan that is partially offset relative to a core portion of a vehicle mounted heat converter. The fan shroud has an arcuate portion that is offset from the core portion. The fan shroud also has an arcuate portion and a connection portion that are not offset from the core portion. The fan shroud has an overlap ratio defined as a ratio of the portion of the fan blades covered by the fan shroud in the cooling fan to the axial depth (front end to rear end) of blades. The overlap ratio at the arcuate portion is set smaller than the overlap ratio at the arcuate portion and the connection portion.

8 Claims, 6 Drawing Sheets

| Constant Parameters | | | |
|---|---|---|---|
| Fan Rotational Speed: | N = 950 rpm | | |
| Lower Overlap Ratio: | $\Delta_3$ = 75% | | |
| Intermediate Overlap Ratio: | $\Delta_2$ = 60% | | |
| Variable Parameters | | | |
| Upper Overlap Ratio $\Delta_1$ (%) | 25 | 50 | 75 |
| Air Amount ($m^3$ / min) | 35.46 | 36.24 | 35.30 |

FAN SHROUD FOR VEHICLE MOUNTED HEAT CONVERTER

BACKGROUND OF THE INVENTION

1. Field of the Invention

The present invention generally relates to a fan shroud that covers an outer periphery of a cooling fan that is disposed rearwardly of a vehicle mounted heat converter such as a radiator. More specifically, the present invention relates a fan shroud for a vehicle mounted heat converter in which the cooling fan is disposed such that a portion of the cooling fan is located above a core of the heat converter.

2. Background Information

In a cooling fan for a heat converter such as a radiator mounted on a vehicle, an adequate amount of air is effectively obtained by covering a periphery of the cooling fan with a fan shroud, and also by adjusting the shape of the fan shroud. A main engine that is disposed rearwardly of the cooling fan is an obstacle with respect to the rear airflow from the fan. However, when the distance between the cooling fan and the engine or obstacle is short, a mixed airflow fan is utilized that sends the rear airflow from the fan in a diagonally rear direction in order to reduce the resistance.

Most cases in a vehicle, the fan shroud and the cooling fan are disposed rearwardly of a heat converter such as a radiator. An "overlap ratio (b/a)" of the blades of the cooling fan to the fan shroud is one of the important factor among factors that relate to the shape of the fan shroud in order to maximize the performance capacity of the cooling fan as possible with minimal losses. In the "overlap ratio (b/a)", the dimension "a" represents the axial depth of the fan blades of the cooling fan in the axial direction. The dimension "b" represents the axial dimension of a side portion of the fan blades of the cooling fan that is covered with the fan shroud. In other words, the overlap ratio is defined as the ratio of an axial dimension of the fan shroud that axially covers a portion of the fan blades relative to the overall axial depth of the fan blades Generally, when "overlap ratio" is small, a reversed airflow can occur within the fan shroud. Also, suction from outside the fan shroud can occur on the downstream side of the fan blades of the cooling fan. Accordingly, the amount of the airflow may decrease through the radiator. Conversely, when a mixed airflow fan is utilized with a large overlap ratio, the overlapping portion of the fan shroud (the portion that corresponds to dimension "b" becomes an obstacle to the mixed airflow. Accordingly, the amount of the airflow may decrease through the radiator. Therefore, it is necessary to adjust the shape of the shroud besides increasing the overlap ratio, such that the shroud will not be an obstacle to the mixed airflow.

In view of the above, there exists a need for a fan shroud which overcomes the above mentioned problems in the prior art. This invention addresses this need in the prior art as well as other needs, which will become apparent to those skilled in the art from this disclosure.

SUMMARY OF THE INVENTION

It has been discovered that there has been a recent tend towards designing vehicles with lower hoods and shorter overhangs. For instance, if a front end of the hood becomes lower, the mounting position of the heat converter or radiator in the vehicle becomes lower. Accordingly, the height of the heat converter or radiator has to be shortened. Therefore, the cooling fan is disposed so as to be offset upward relative to the heat converter or radiator. Accordingly, a portion of the cooling fan is above an upper end of a core portion of the heat converter or radiator. In this case, in order to shorten the height of the fan shroud, the shape of the fan shroud at a portion that corresponds to the offset portion should be in a ring shape so as to conform to the shape of the fan. However, when the portion that corresponds to the offset portion is formed into a ring shape, the aforementioned resistance against the mixed airflow becomes substantially large, which is not preferable.

Since the cooling fan is offset upward, the flow of the cooling air from heat converter to the cooling fan is oriented in a diagonally upward direction at the offset portion. Accordingly, the resistance increases in the air flowing from heat converter to the cooling fan. In particular, in the case of a short overhung vehicle where the distance between heat converter and the cooling fan is short, this tendency increased resistance is more prevalent. The cooling air that passed through the heat converter suddenly flows upward in the vicinity of the cooling fan. As a result, there is more resistance in the offset portion. Accordingly, the amount of the airflow may decrease in this region.

An object of the present invention is to provide a fan shroud for a vehicle mounted heat converter that can effectively obtain the necessary amount of air, where a portion of the cooling fan is disposed above the core of the heat converter within the fan shroud.

According to one aspect of the present invention, a fan shroud is provided for a vehicle mounted heat converter that covers a side periphery of fan blades of a cooling fan, which is partially offset from a core portion of the heat converter when viewed from a front side of the heat converter. The fan shroud basically comprises a non-offset shroud portion disposed about a non-offset section of the fan blades, and an offset shroud portion disposed adjacent the non-offset shroud portion and disposed about an offset section of the fan blades. The non-offset shroud portion has a non-offset overlap ratio at the non-offset section of the fan blades. The non-offset overlap ratio is defined as a ratio of a first axial dimension of the non-offset shroud portion that axially covers a portion of the fan blades relative to the overall axial depth of the fan blades. The offset shroud portion has an offset overlap ratio at the offset section of the fan blades. The offset overlap ratio is defined as a ratio of a second axial dimension of the offset shroud portion that axially covers a portion of the fan blades relative to an overall axial depth of the fan blades. The offset overlap ratio at the offset shroud portion is smaller than the non-offset overlap ratio at the non-offset shroud portion. In this manner, the aforementioned object is achieved.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

Figure 1:
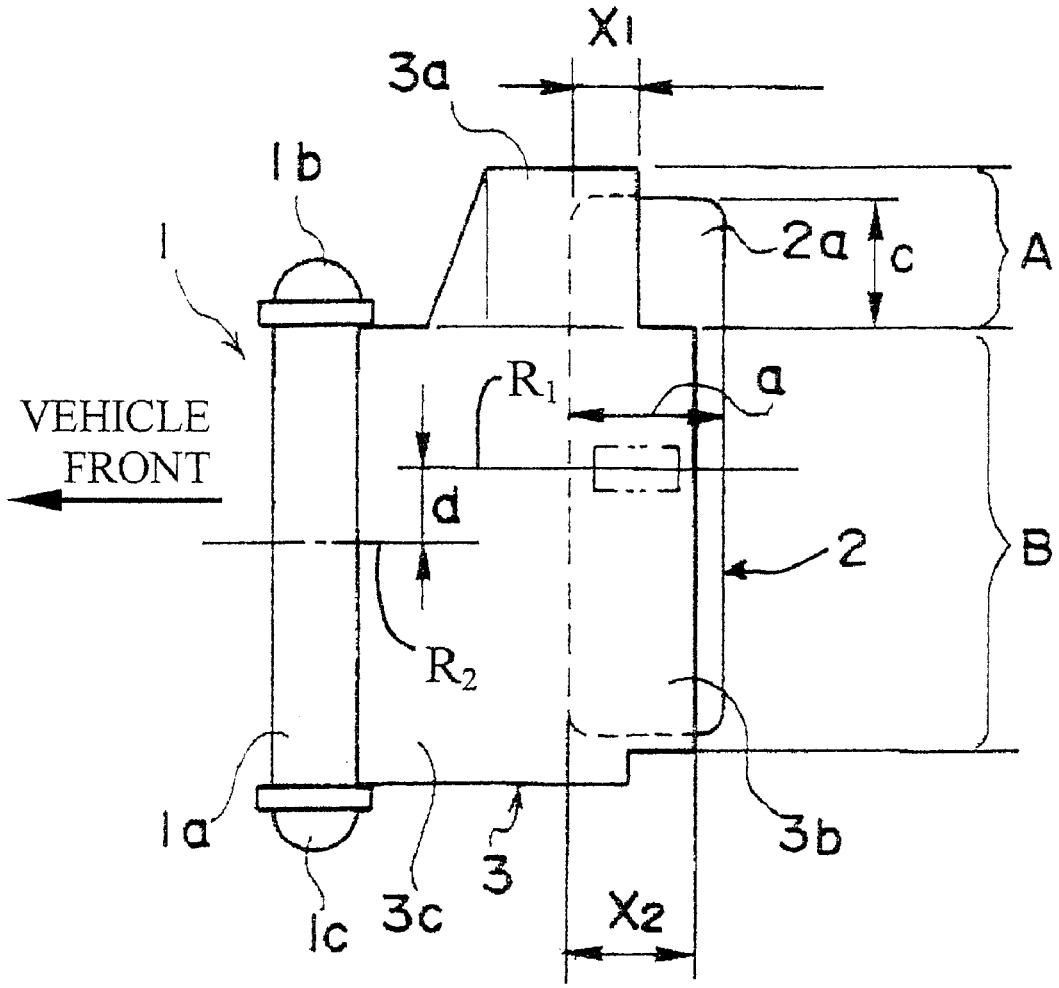
FIG. 1 is a schematic side elevational view of a-fan shroud for a vehicle mounted heat converter in accordance with a first embodiment of the present invention, showing a simplified shape of the fan shroud.

Referring initially to FIG. 1, a vehicle mounted heat converter or radiator 1 is illustrated having a cooling fan 2 equipped with a fan shroud 3 in accordance with a first embodiment of the present invention. The fan shroud 3 is configured to overlap with the blades 2*a* of the cooling fan 2 to provide optimum airflow in the area between the radiator 1 and the cooling fan 2. The "overlap ratio" of the fan shroud 3 in accordance with the present invention will first be explained referring to the FIG. 1. In FIG. 1, the radiator 1 forms the heat converter in accordance with the present invention. The cooling fan 2 is disposed rearwardly of the radiator 1. The cooling fan 2 is equipped with the fan shroud 3 to effectively control the amount of external air that passes through a radiator core portion 1*a* of the radiator 1.

The radiator core portion 1*a* has fluid carrying tubes (not shown in Figures) through which cooling water flows from an upper receiving tank 1*b* to a lower dispensing tank 1*c*, and a plurality of radiation fins (not shown in Figures) that are provided around the tubes. The temperature of the cooling water inside the tubes decreases as the external air passes rearward through the radiator core portion 1*a*. Since radiators are well known in the art, the structures of the radiator 1 will not be discussed or illustrated in detail herein.

In FIG. 1, the rotational center $R_1$ of the cooling fan 2 is offset upward relative to the vertical center $R_2$ of the radiator core portion 1*a* by an offset amount "d". Therefore, an upper offset section of the cooling fan 2 is above an upper end of the radiator core portion 1*a* by a dimension "C". The fan shroud 3 has an offset shroud portion 3*a*, a non-offset shroud portion 3*b* and a core connection portion 3*c*. As described above, in order to lower the height of the fan shroud 3, the offset shroud portion 3*a* has an arc shape that closely encircles the outer arc of the fan blades 2*a* of the cooling fan 2.

The fan shroud 3 extends rearward from the rear end of the radiator core portion 1*a*. In this manner, the fan shroud 3 is formed so as to cover a side periphery of the fan blades 2*a* of the cooling fan 2. For this reason, the cross sectional shape of the core connection portion 3*c* of the fan shroud 3 in the vicinity of the rear end surface of the radiator core portion 1*a* is rectangular in cross sectional shape to correspond to the rectangular cross sectional shape of the radiator core portion 1*a*. The cross section of the non-offset shroud portion 3*b* near the cooling fan 2 has an arc shape, similar to the cross sectional shape of the offset portion 3*a*. Hereinafter, the arc-shaped portions will be referred to as an arcuate portion. In other words, the fan shroud 3 shown in FIG. 1 has the arcuate portions 3*a* and 3*b*, and the core connection portion 3*c*.

The dimension "A" in FIG. 1 is the amount of offset of the core outer periphery of the arcuate portion 3*a* from the radiator core portion 1*a*. Therefore, the dimension "A" is referred to as offset dimension "A". On the other hand, the dimension "B" that overlaps with the radiator core portion 1*a* and cannot be seen from a front view will be referred to as non-offset dimension "B". The arcuate portion 3*a* of the fan shroud 3 is in the offset dimension "A" , whereas the arcuate portion 3*b* and the connection portion 3*c* are in the non-offset dimension "B".

In the fan shroud 3, the overlap ratios $\Delta_1$ and $\Delta_2$ at the arcuate portion 3*a* and the arcuate portion 3*b* relative to the fan blades of the cooling fan 2 are given by the equations (1) and (2). The quantitative relationship between the overlap ratios $\Delta_1$ and $\Delta_2$ is set forth in the equation (3). According to an experiment, a favorable result was obtained when the overlap ratio $\Delta_2$ was set at about 75%.

Equations 1–3:

$$\Delta_1=(x_1/a) \quad (1)$$

$$\Delta_2=(x_2/a) \quad (2)$$

$$0<\Delta_1<\Delta_2 \quad (3)$$

As seen in FIG. 1, since the cooling fan 2 is offset upward relative to the radiator core portion 1*a*, there is a greater tendency that the cooling air becomes a mixed airflow at the arcuate portion 3*a* than at the arcuate portion 3*b*. Therefore, by making the overlap ratio $\Delta_1$ smaller at the arcuate portion 3*a* that is an obstacle to the mixed airflow, and at the same time by making the overlap ratio $\Delta_2$ greater at the arcuate portion 3*b* where the tendency toward mixed airflow is smaller, the amount of air can be increased. By setting the overlap ratio $\Delta_1$ at the arcuate portion 3*a*, where there is a great tendency toward mixed airflow smaller, and the overlap ratio $\Delta_2$ at the arcuate portion 3*b* and the connection portion 3*c*, where there is a relatively smaller tendency toward mixed airflow greater than the overlap ratio $\Delta_1$ at the arcuate portion 3*a*, it is possible to increase the amount of air. In particular, a preferable result can be obtained by setting the overlap ratio $\Delta_1$ as about 50%. In other words, the overlap ratio at the offset portion is approximately 50%. Therefore, it is possible to increase the airflow amount even more effectively.

The fan shroud has a plurality of overlap ratios. The overlap ratio is set to increase as the tendency toward mixed airflow decreases from the overlap ratio at the offset portion. Therefore, it is possible to set the overlap ratio of the fan shroud more precisely. Accordingly, it is possible to set the overlap ratio precisely in accordance with the size of the offset portion and the distance between the heat converter and the cooling fan. Therefore, the optimum amount of air can be obtained.

SECOND AND THIRD EMBODIMENTS

Figure 2:
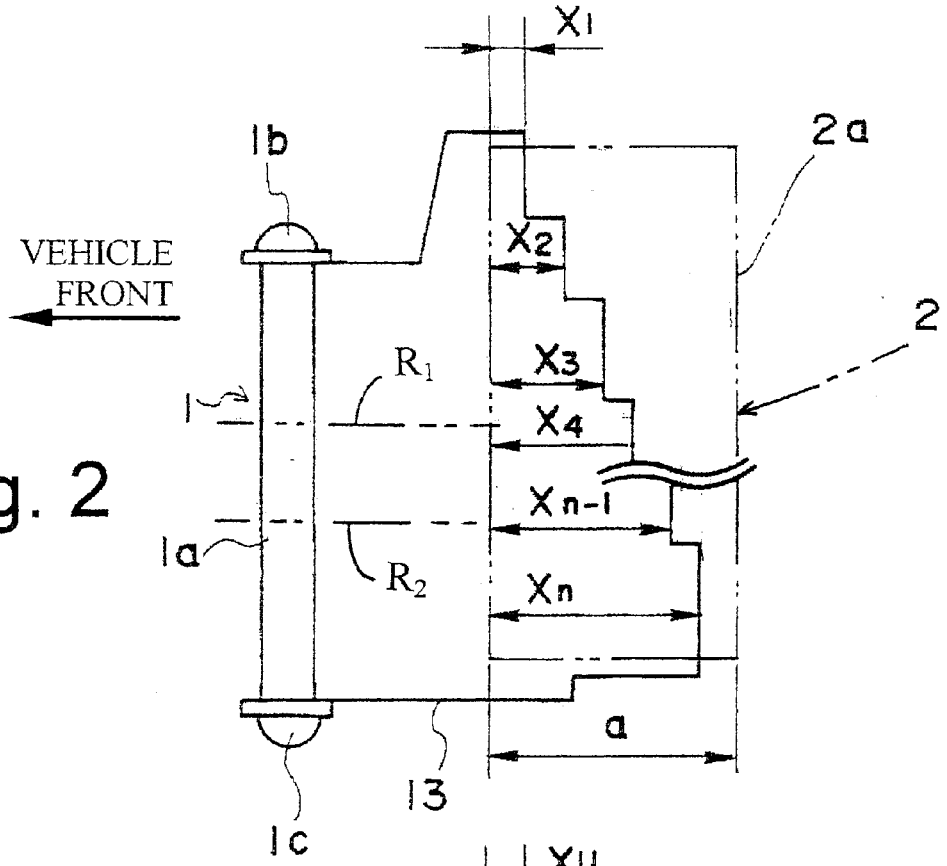
FIG. 2 is a schematic side elevational view of a fan shroud in accordance with another embodiment, where the fan shroud has "n"types of overlap ratios.
Figure 3:
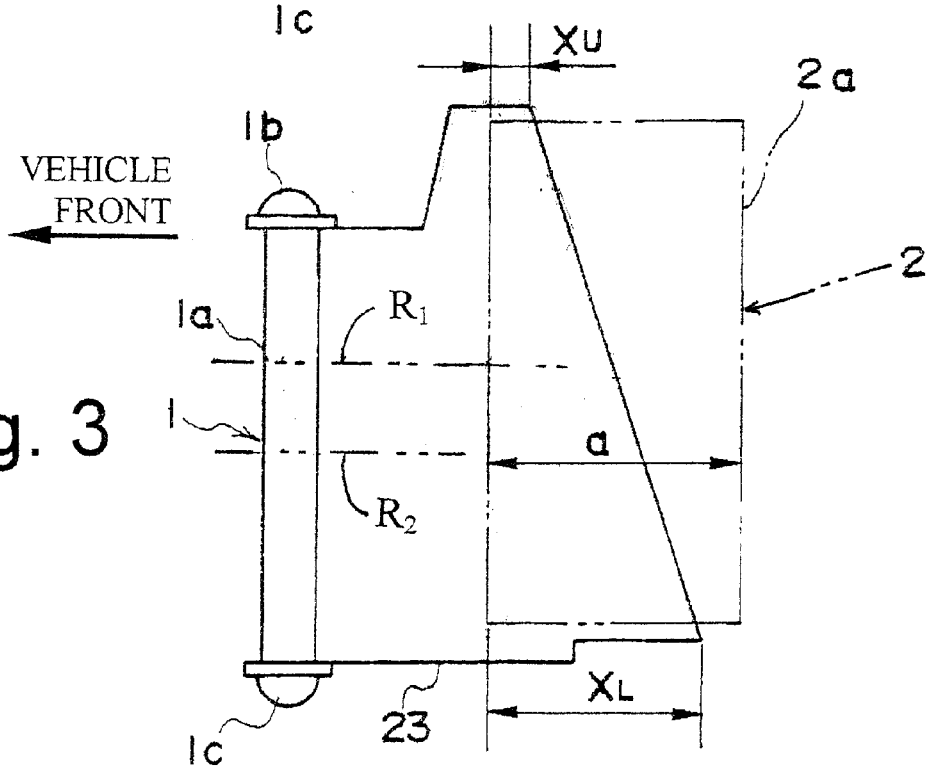
FIG. 3 is a schematic side elevational view of a fan shroud in accordance with another embodiment, where the overlap ratio at the fan shroud changes continuously.

Referring now to FIGS. 2 and 3, two modified fan shrouds 13 and 23 are illustrated in accordance with second and third embodiments, which will now be explained. In view of the similarity between the first embodiment and the second and third embodiments, the parts of the second and third embodiments that are identical to the parts of the first embodiment will be given the same reference numerals as the parts of the first embodiment. Moreover, the descriptions of the parts of the second and third embodiments that are identical to the parts of the first embodiment may be omitted for the sake of brevity.

Although the fan shroud 3 shown in FIG. 1 has a structure that has two types of overlap ratios $\Delta_1$ and $\Delta_2$, it is possible to construct the fan shroud 3 so as to have three or more types of overlap ratios. FIG. 2 shows a situation where the fan shroud 13 has "n" types of overlap ratios. The magnitudes of the overlap ratios $\Delta_1$-$\Delta_n$. are as shown in the next equation (4), in which the overlap ratios increase such that an overlap ratio at an upper side is smaller than an overlap ratio at a lower side. In this manner, by increasing the number of types of overlap ratios and setting overlap ratios more precisely, the fan shroud 13 can be configured in a more optimum manner. Therefore, the amount of air can be increased. Also, the overlap ratios become smaller as the shroud section becomes closer to an upper end of the fan shroud 13. This is desired because when the cooling fan 2 is offset upward relative to the core portion 1*a*, there is a greater tendency toward mixed airflow at an upper side of the fan shroud 13.

Equation 4:

$$0<\Delta_1<\Delta_2<\Delta_3 \ldots <\Delta_{n-1}<\Delta_n \quad (4)$$

where $\Delta_1=x_1/a$, $\Delta_2=X_2/a$, . . . $\Delta_n=x_n/a$.

When "n" in FIG. 2 is increased infinitely, the overlap ratio continuously changes from the overlap ratio at the upper end of the shroud 23 to the overlap ratio at the lower end of the shroud 23 as shown in FIG. 3. In the fan shroud 23, the overlap ratio at the upper end portion is $\Delta_u$ ($=X_U/a$), and the overlap ratio at the lower end portion is $\Delta_L$($=X_L/a$), with $\Delta_U$ and $\Delta_L$ satisfying $0<\Delta_U<\Delta_L$. Although the fan shroud 23 has a linear shape in FIG. 3, the fan shroud may also have a bent shape or a curved shape. In either case, the overlap ratio is set so as to be smaller on the upper end of shroud 23. The overlap ratios are set to continuously increase from the offset portion to the non-offset portion, in other words as the tendency toward mixed airflow increases. Therefore, it is possible to set the overlap ratio even more precisely. Also, it is possible to set the optimum overlap ratio depending on the shape of the fan shroud.

FOURTH EMBODIMENT

Figure 4:
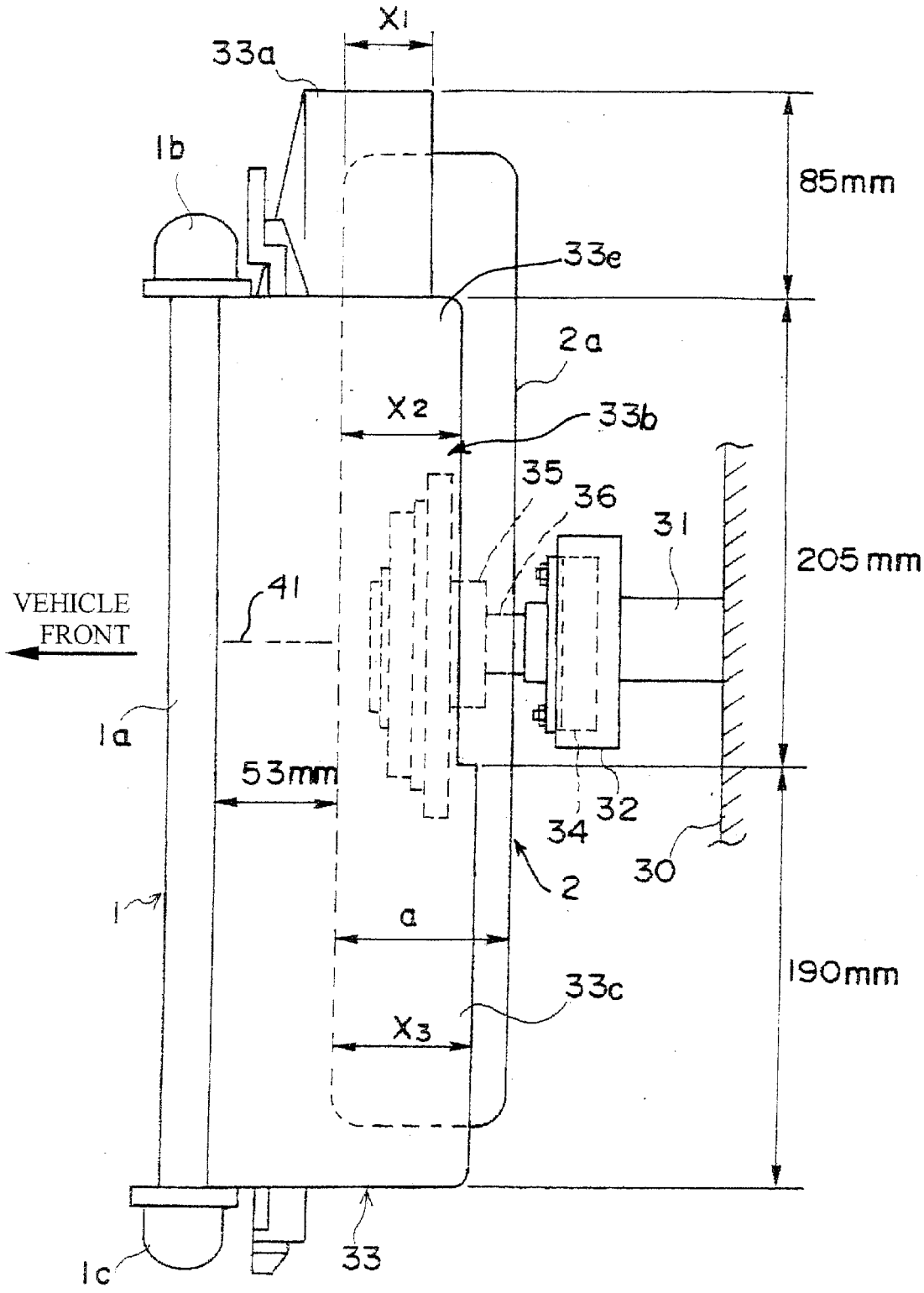
FIG. 4 is a side elevational view of a specific example of a fan shroud mounted in a vehicle, as viewed from the side of the vehicle.
Figure 5:
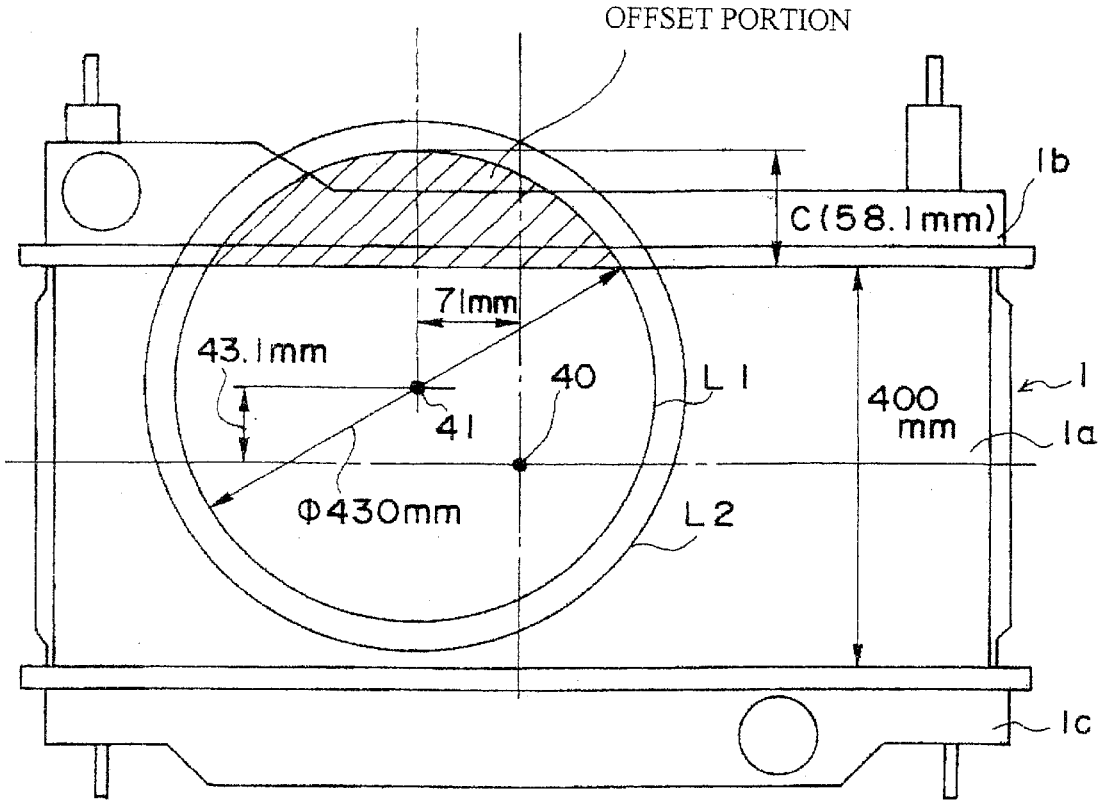
FIG. 5 is a front elevational view of a radiator shown in FIG. 4 as viewed from the front of the vehicle, a n d showing the positional relationship between the core portion of the radiator and the outer peripheral path of the fan blades of the cooling fan.
Figure 6:
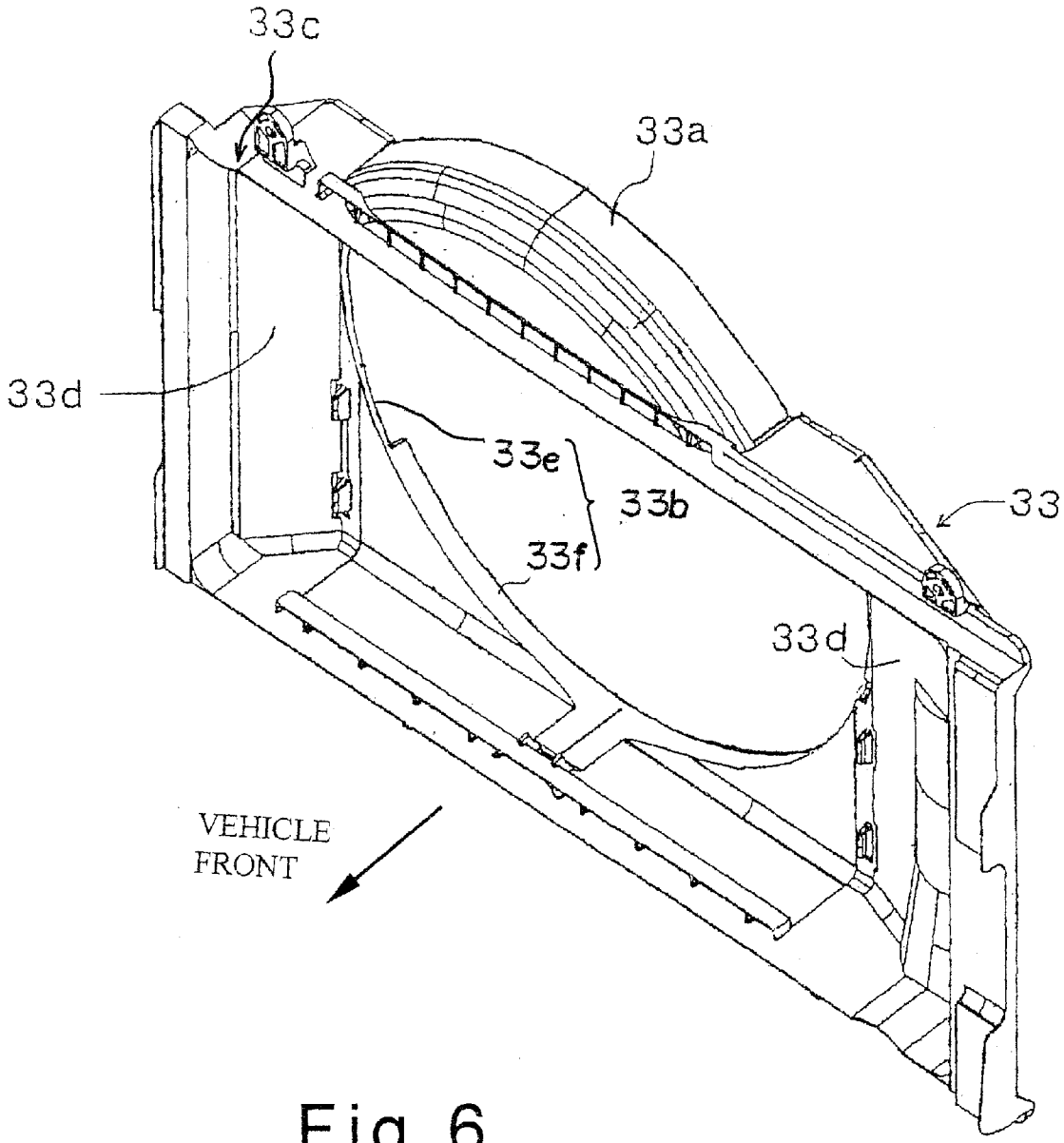
FIG. 6 is a perspective view of the fan shroud illustrated in FIGS. 4 and 5.

Referring now to FIGS. 4–6, a fan shroud 33 is illustrated with three types of overlap ratios in accordance with a fourth embodiment, which will now be explained. In view of the similarity between the fourth embodiment and the prior embodiments, the parts of the prior embodiments that are identical to the parts of the fourth embodiment will be used for the parts of the fourth embodiment. Moreover, since the fourth embodiment is shown in more detail, the descriptions of the parts in this fourth embodiment can be used to understand the parts of the prior embodiments.

Referring to FIG. 4, the fan shroud 33 is mounted on a vehicle in a conventional manner. The fan shroud 33 is installed rearwardly of the radiator 1, so as to encircle the side periphery of the fan blades 2*a* of the cooling fan 2. Thus, the fan shroud 33 acts as air directing means for controlling airflow between the radiator 1 and the cooling fan 2. The fan shroud 33 has an offset shroud portion 33*a*, a non-offset shroud portion 33*b*, a core. connection portion 33*c* and a pair of side portions 33*d*. Preferably, the offset shroud portion 33*a* and the non-offset shroud portion 33*b* have arc shapes that closely encircle the outer arc of the fan blades 2*a* of the cooling fan 2. The non-offset shroud portion 33*b* includes a first shroud section 33*e* and a second shroud section 33*f*. The core connection portion 33*c* acts as connecting means for positioning the fan shroud 33 adjacent the rearwardly facing side of the radiator 1. Preferably, the core connection portion 33*c* has mounting flanges that are attached to the radiator 1 via fasteners such as bolts, clips or other fastening means.

The cooling fan 2 is attached to an axle 36 via a coupling 35. The axle 36 is operatively coupled to an engine 30 for rotation to via a crankshaft 31 of the engine 30. The rotational torque of the crankshaft 31 is transmitted to the axle 36 via a pair of pulleys 32 and 34 that are attached to the crankshaft 31 and the axle 36, thereby rotating the cooling fan 2 about the rotational center axis 41.

FIG. 5 is a view of the radiator 1 as viewed from the front of the vehicle. FIG. 6 is a perspective view of the fan shroud 33. As shown in FIG. 5, the radiator core portion 1*a* of the radiator 1 has a rectangular shape with a vertical center 40. The rotational center 41 of the cooling fan 2 is offset in an upward direction by 43.1 mm, and in a leftward direction by 71 mm, relative to the vertical center 40 of the radiator core portion 1*a*, as seen in the FIG. 5. The circular path L1 indicates an outer periphery of the fan blades 2*a* of the cooling fan 2. A portion of the cooling fan 2 (hatched area) is disposed above an upper portion of the radiator core portion 1*a*. The area of this offset portion is about 16% of the area inside the circular path L1.

As seen in FIG. 5, the circular path L2 shows the shape of the ring portion of the fan shroud 33, which corresponds to the arcuate portions 33*a*, 33*e* and 33*f* of FIG. 6. As shown in FIG. 6, a front end of the fan shroud 33 has a rectangular shape so as to conform to the shape of the radiator core portion 1*a*. The side portions 33*d* are inwardly inclined from the front end such that rear portion tapers towards an inner side. The fan shroud 33 also has upper and lower portions as seen in FIG. 5 such that a closed or substantially closed area is formed in front of the arcuate portions 33*a*, 33*e* and 33*f*. The rear ends of the fan shroud 33 form the aforementioned arcuate portions 33*a*, 33*e* and 33*f*. As seen in FIG. 5, the arcuate portion 33*a* is offset upward so as to be above the radiator core portion 1*a*.

Referring back to FIG. 4, the fan shroud 33 has three types of overlap ratios. In particular, an upper overlap ratio $\Delta_1$ is formed at the arcuate portion 33*a*. A lower overlap ratio $\Delta_3$ is formed at the arcuate portion 33*f* An intermediate overlap ratio $\Delta_2$ is formed the arcuate portion 33*e* in FIG. 4. Thus, the overlap ratio at the fan shroud 33 is divided into three levels or sections, such that the overlap ratios increase as the fan shroud 33 moves from a portion where mixed airflow is likely to occur to a portion where mixed airflow is less likely to occur. Therefore, it is possible to set the overlap ratio more precisely. Accordingly, the airflow amount can be increased even more effectively.

The overlap ratios satisfy the equation (5), indicated below. The vertical dimensions for the overlapping arcuate portions 33*a*, 33*e* and 33*f* are preferably about 85 mm, 205 mm, and 190 mm, respectively. The dimension between the rear end of the radiator core portion 1*a* and the front end of the fan blades 2*a* of the cooling fan 2 is about 53 mm.

Equation 5:

$$\Delta_1=X_1/a,\ \Delta_2=X_2/a,\ \Delta_3=X_3/a \quad (5)$$

Figures 7, 8:
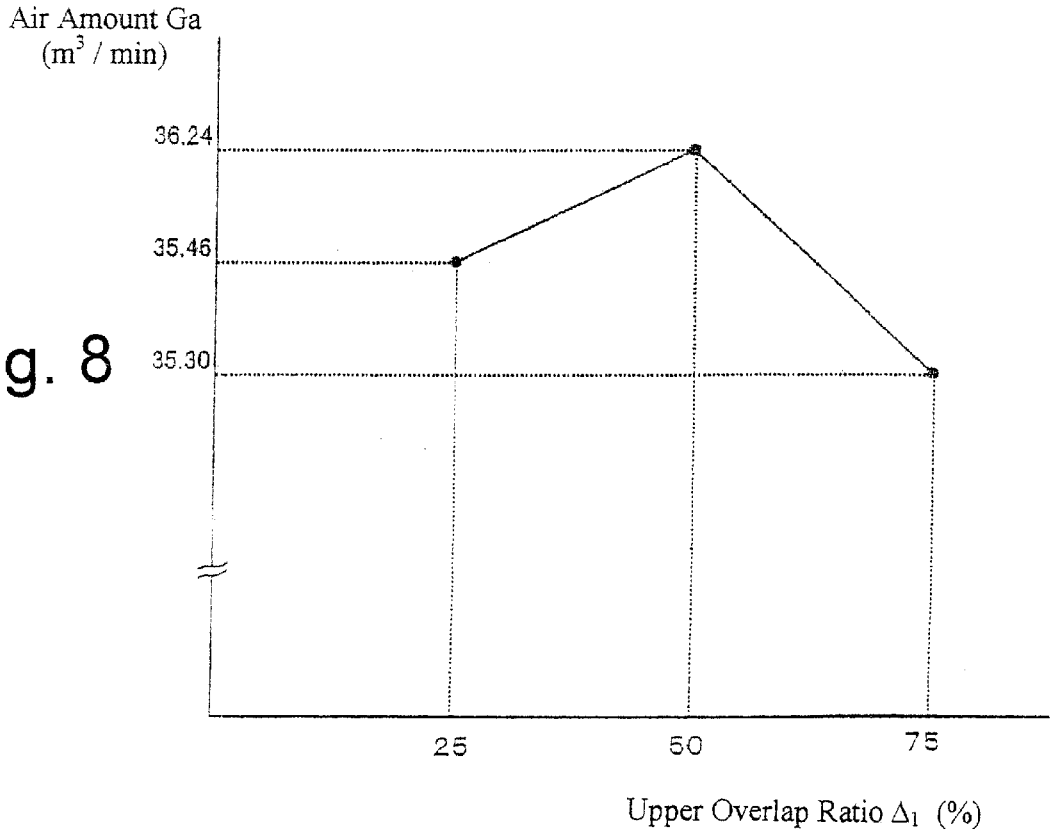
FIG. 7 is a table showing experimental results of the airflow amount measurements from a fan shroud has "n" accordance with one embodiment of the present invention.
FIG. 8 is a graph showing the relationship between an upper overlap ratio $\Delta_1$ and an airflow amount, based on the experimental results of the airflow amount measurements set forth in the table of FIG. 7.

FIG. 7 is a table showing results of the airflow amount measurements from a fan shroud in accordance with one embodiment of the present invention. FIG. 8 is a graph showing the relationship between an upper overlap ratio $\Delta_1$ and an airflow amount Ga, based on the results of the airflow amount measurements of the table in FIG. 7. Here, a change in airflow amount Ga is observed where the intermediate overlap ratio $\Delta_2$ and the lower overlap ratio $\Delta_3$ are respectively set as 60% and 75%, with the upper overlap ratio $\Delta_1$ being changed to 25%, 50%, and 75%. As seen in FIG. 7, the airflow amount Ga is greatest when upper overlap rate $\Delta_1$ is 50%. Therefore, the optimum value of the upper overlap rate $\Delta_1$ is around 50%.

In this manner, when the overlap ratio is divided into three layers, as in the fourth embodiment of FIGS. 4–6, the optimum airflow amount can be obtained when the overlap ratios increase in the order of the upper overlap ratio (about 50%), the intermediate overlap ratio (about 60%), and the lower overlap ratio (about 75%). However, as seen in FIG. 8, the airflow amount decreases when the offset amount at the upper level is at about 25%. Therefore, the offset amount should not be too small. Accordingly, the offset amount should be set as an optimum amount.

As used herein, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

The terms of degree such as "substantially" , "about " and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2000-222626. The entire disclosure of Japanese Patent Application No. 2000-222626 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents. Thus, the scope of the invention is not limited to the disclosed embodiments.

What is claimed is:

1. A fan shroud for a vehicle comprising:

air directing means for controlling airflow between a core portion of a heat converter portion and fan blades of a cooling fan, the air directing means covering a side periphery of the fan blades of the cooling fan, the air directing means having an offset portion disposed about an offset section of the fan blades and a non-offset portion disposed about a non-offset section of the fan blades, the offset portion having an offset overlap ratio at the offset section of the fan blades, the non-offset portion having a non-offset overlap ratio at the non-offset section of the fan blades, each of the offset and non-offset overlap ratios being defined as ratios of axial dimensions of the air directing means that axially covers a portion of the fan, blades relative to the overall axial depth of the fan blades, the non-offset portion including a first section disposed adjacent the offset portion and a second section disposed adjacent the first section, the non-offset overlap ratio having a first non-offset overlap ratio at the first section and a second non-offset overlap ratio at the second section, the first non-offset overlap ratio at the first section being greater than the offset overlap ratio at the offset portion, the second non-offset overlap ratio at the second section being greater than the first non-offset overlap ratio at the first section.

2. The fan shroud as set forth in claim 1, further comprising:

connecting means for positioning the air directing means adjacent a rearwardly facing side the heat converter.

3. The fan shroud as set forth in claim 1, wherein the offset overlap ratio at the offset portion is approximately 50%.

4. The fan shroud as set forth in claim 1, wherein the offset overlap ratio at the offset portion is approximately 50%;

the first non-offset overlap ratio at the first section is approximately 60%; and the second non-offset overlap ratio at said second section is approximately 75%.

5. A fan shroud for a vehicle mounted heat converter that covers a side periphery of fan blades of a cooling fan, which is partially offset from a core portion of the heat converter when viewed from a front side of the heat converter, the fan shroud comprising:

a non-offset shroud portion disposed about a non-offset section of the fan blades, the non-offset shroud portion having a non-offset overlap ratio at the non-offset section of the fan blades, the non-offset overlap ratio being defined as a ratio of a first axial dimension of the non-offset shroud portion that axially covers a portion of the fan blades relative to the overall axial depth of the fan blades; and an offset shroud portion disposed adjacent said non-offset shroud portion and disposed about an offset section of the fan blades, the offset shroud portion having an offset overlap ratio at the offset section of the fan blades, the offset overlap ratio being defined as a ratio of a second axial dimension of the offset shroud portion that axially covers a portion of the fan blades relative to an overall axial depth of the fan blades, the offset overlap ratio at the offset shroud portion being smaller than the non-offset overlap ratio at the non-offset shroud portion, the non-offset shroud portion including a first shroud section disposed adjacent the offset shroud portion and a second shroud section disposed adjacent the first shroud section, the non-offset overlap ratio having a first non-offset overlap ratio at the first shroud section and a second non-offset overlap ratio at the second shroud section, the first non-offset overlap ratio at the first shroud section being greater than the offset overlap ratio at the offset shroud portion, the second non-offset overlap ratio at the second shroud section being greater than the first non-offset overlap ratio at the first shroud section.

6. The fan shroud as set forth in claim 5, further comprising:

a connecting portion extending from the non-offset shroud portion and the offset shroud portion.

7. A fan shroud for a vehicle mounted heat converter that covers a side periphery of fan blades of a cooling fan, which is partially offset from a core portion of the heat converter when viewed from a front side of the heat converter, the fan shroud comprising:

a non-offset shroud portion disposed about a non-offset section of the fan blades, the non-offset shroud portion having a non-offset overlap ratio at the non-offset section of the fan blades, the non-offset overlap ratio being defined as a ratio of a first axial dimension of the non-offset shroud portion that axially covers a portion of the fan blades relative to the overall axial depth of the fan blades; and an offset shroud portion disposed adjacent said non-offset shroud portion and disposed about an offset section of the fan blades, the offset shroud portion having an offset overlap ratio at the offset section of the fan blades, the offset overlap ratio being defined as a ratio of a second axial dimension of the offset shroud portion that axially covers a portion of the fan blades relative to an overall axial depth of the fan blades, the offset overlap ratio at the offset shroud portion being smaller than the non-offset overlap ratio at the non-offset shroud portion, the non-offset shroud portion including a first shroud section disposed adjacent the offset shroud portion and a second shroud section disposed adjacent the first shroud section, the non-offset overlap ratio having a first non-offset overlap ratio at the first shroud section and a second non-offset overlap ratio at the second shroud section, the first non-offset overlap ratio at the first shroud section being greater than the offset overlap ratio at the offset shroud portion, the second non-offset overlap ratio at the second shroud section being greater than the first non-offset overlap ratio at the first shroud section, the offset overlap ratio at the offset shroud portion being approximately 50%.

8. The fan shroud as set forth in claim 7, wherein the first non-offset overlap ratio at the first shroud section is approximately 60%; and the second non-offset overlap ratio at the second shroud section is approximately 75%.

* * * * *